US005172945A

United States Patent [19]

Doherty et al.

[11] Patent Number: 5,172,945

[45] Date of Patent: Dec. 22, 1992

[54] TRI-AXIAL SUPPORT DOOR LATCH

[75] Inventors: Terence M. Doherty, White Lake; Michael G. Bogos, Howell; Jeffrey D. Polzin, Fenton; Giovanni A. Perin, Rochester Hills, all of Mich.

[73] Assignee: General Motors Corporation, Detroit, Mich.

[21] Appl. No.: 857,551

[22] Filed: Mar. 23, 1992

[51] Int. Cl.[5] ..... E05C 19/10

[52] U.S. Cl. ..... 292/49; 292/DIG. 72; 292/DIG. 14; 292/47

[58] Field of Search ..... 292/49, DIG. 72, DIG. 14, 292/34, 26, 341.16, 25, 27, 44, 45, 30, 46, 47, 53

[56] References Cited

U.S. PATENT DOCUMENTS

| | | | |
|---|---|---|---|
| 786,961 | 4/1905 | Drakes . | |
| 1,297,284 | 3/1919 | Wisnicwski | 292/DIG. 72 |
| 2,118,729 | 5/1938 | Hogan | 292/27 |
| 2,446,113 | 7/1948 | Spiller | 292/30 |
| 2,486,003 | 10/1949 | Christensen | 292/59 |
| 2,715,538 | 8/1955 | Janonis | 292/DIG. 14 |
| 2,832,621 | 4/1958 | Orlow | 292/DIG. 14 |
| 3,003,800 | 10/1961 | Hammond | 292/11 |
| 4,597,599 | 7/1986 | Bisbing | 292/DIG. 72 |
| 4,836,707 | 6/1989 | Myers | 292/34 |
| 4,917,417 | 4/1990 | Aubry | 292/DIG. 14 |
| 5,004,280 | 4/1991 | Schap | 292/341.16 |

*Primary Examiner*—Eric K. Nicholson
*Attorney, Agent, or Firm*—William A. Schuetz

[57] ABSTRACT

A vehicle closure latch mechanism that prohibits relative movement between a latch bolt and a latch assembly so as to prohibit the creation of noise during random vibration caused by the operation of the vehicle. The closure latch mechanism restrains the latch bolt from moving in any lateral direction relative to its longitudinal axis and also restrains axial movement outwardly toward the open position, as well as resisting axial movement inwardly toward the closed position.

4 Claims, 3 Drawing Sheets

TRI-AXIAL SUPPORT DOOR LATCH

The present invention relates, in general, to vehicle closure latch mechanisms and more particularly to a vehicle closure latch mechanism that prohibits relative movement between the latching portions of the vehicle closure latch mechanism.

BACKGROUND OF THE INVENTION

Generally, almost all vehicle closure latch mechanisms provide a releasable latching method to secure a closure to a vehicle structure in order to close an access opening. Typically, the closure latch mechanism includes a latch bolt mounted to the closure which engages a latch assembly mounted to the vehicle structure upon the closure moving to the closed position. When latched, the latch bolt is typically resisted and restrained from moving in one or several directions, but the latch bolt is still allowed to move relative to the latch assembly in some other direction. When a latch bolt is allowed to move relative to the latch assembly, and such a latch assembly is subjected to random vibrations associated with the operation of a vehicle, noise is created through the physical contact between the latch bolt and the latch assembly. Also, if the latch bolt is rigidly mounted to the closure, and the latch bolt is allowed to move, the closure may come in and out of contact with the vehicle structure during operation of the vehicle thereby causing noise to be created. Such noise is annoying to vehicle passengers, especially when such closure latch mechanisms are used in various vehicle passenger compartment door applications, such as vans.

SUMMARY OF THE INVENTION

The present invention solves the above-mentioned problem by providing a latch assembly that positively restrains the movement of a latch bolt relative to the latch assembly in all but one direction, while still resisting motion of the latch bolt in the one nonrestrained direction. The present invention is utilized in a vehicle that provides a structure with an access opening and a closure which closes and opens the access opening and is supported by the vehicle structure, such as a sliding passenger compartment door in a van. The latch bolt is rigidly mounted to the closure and engages the latch assembly mounted in the vehicle structure upon the closure reaching a closed position. When the latch bolt is latched in the latch assembly, the latch bolt seats in a cup shaped member thereby providing positive restraint of any lateral movement of the latch bolt relative to its longitudinal axis. Axial movement of the latch bolt is positively restrained outwardly toward an open position by a pair of latching members. Axial movement of the latch bolt inwardly toward the closed position cannot be restrained but rather can only be resisted since the latch assembly must be able to absorb the force of the moving closure, transmitted through the latch bolt, upon the closure moving into the closed position. Rigid mounting of the latch bolt to the closure prevents the latch bolt from rotating about its longitudinal axis. By restraining the latch bolt from moving in all but one direction, and by resisting movement of the latch bolt in the one nonrestrained direction, the latch bolt and latch assembly are prohibited from moving relative to one another and therefore are unable to create noise, either by themselves or by contact of the closure with the vehicle structure.

The idea of resisting and restraining movement of the latch bolt in a vehicle closure latch mechanism is not new, as disclosed in U.S. Patents Hammond No. 3,003,800, Christensen No. 2,486,003, Hogan No. 2,118,729, Drakes No. 786,961 and Spiller No. 2,446,113. However, none of these disclosures provide positive restraint of the latch bolt against movement in all lateral planes and in the axial plane outward toward the opened position, as well as resisting movement in the axial plane inward toward the closed position. The Hammond '800 patent does disclose a latch bolt received in a cylindrical receiver, but the latch bolt is only resisted, not positively restrained, from moving in lateral directions. The Christensen '003 patent, Hogan '729 patent and Drakes '961 patent are all similar in that they disclose a latch assembly which resists lateral movement of the latch bolt in one plane only but does not restrain the latch bolt from movement in any lateral direction. The Spiller '113 patent discloses a latch assembly that resists movement of the latch bolt in both axial directions as well as in one lateral plane, but positive restraint is not provided in any direction.

To this end, the objects of the present invention are to provide a new and improved vehicle closure latch mechanism that prohibits the creation of noise caused by the relative movement of latching members during operation of the vehicle; to provide a new and improved vehicle closure latch mechanism that positively restrains the movement of the latch bolt in all lateral directions relative to its longitudinal axis; to provide a new and improved vehicle closure latch mechanism that positively restrains the movement of the latch bolt in the outwardly axial direction towards the open position and resists the movement of the latch bolt in the inwardly axial direction towards the closed position.

DESCRIPTION OF THE PREFERRED EMBODIMENT

Figure 1:
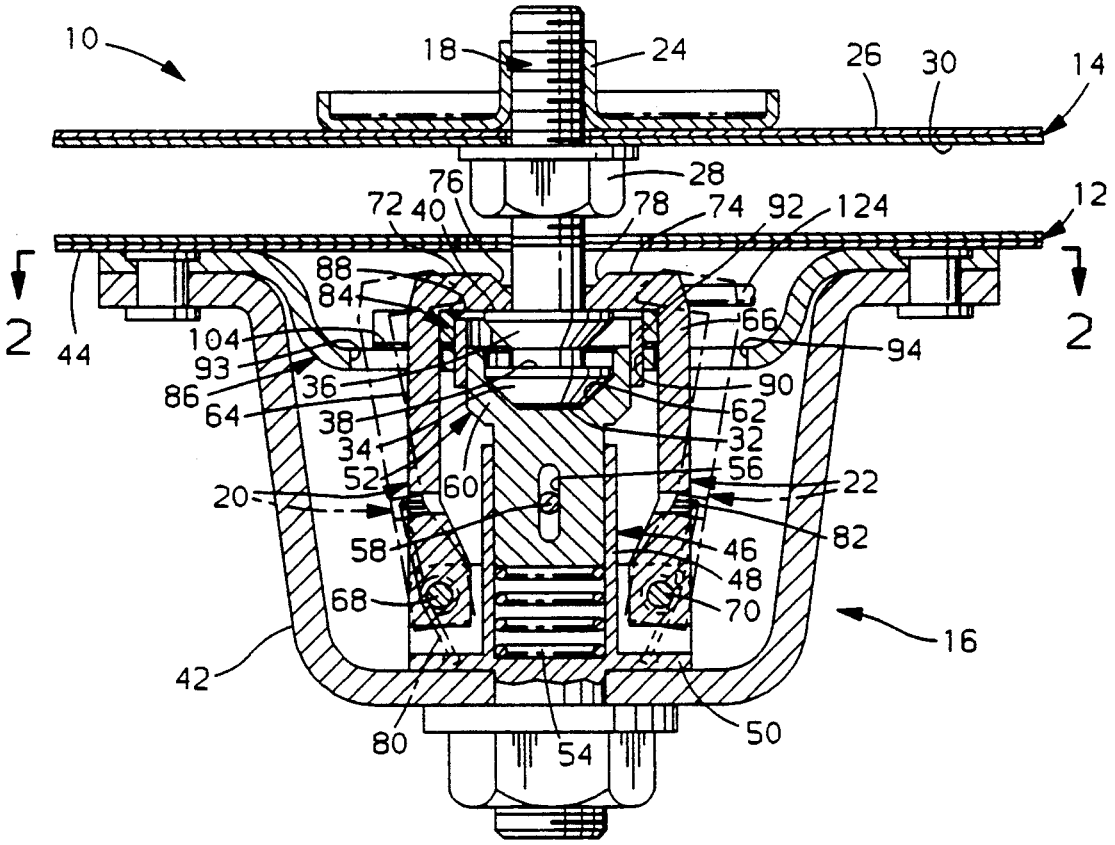
FIG. 1 is a cross-sectional view of the vehicle closure latch mechanism made according to the present invention showing the closed and latched position in full lines and the unlatched position in phantom lines.

Referring to the drawings, the present invention will now be described in detail with reference to the preferred embodiment.

FIG. 1 is a cross-sectional view of a closure latch mechanism (10) for latching a movable closure (14) to its associated support structure (12) of an automotive vehicle, such as a van. The vehicle support structure (12) defines an access opening (not shown), such as a passenger compartment doorway, and provides support for the movable closure (14), such as a passenger compartment door. A latch assembly (16) is rigidly mounted to the vehicle structure (12), and a latch bolt (18) is rigidly mounted to the vehicle closure (14). When the closure (14) is moved to the closed position, thereby closing the access opening, the latch bolt (18) engages a pair of similar latching members (20) and (22), and the closure latch mechanism (10) assumes a latched position as shown by the full lines. To release the latch bolt (18) and allow the closure (14) to move to the open position, the latching members (20), (22) pivot outwardly to an unlatched position shown by the phantom lines.

As seen in FIG. 1, the latch bolt (18) is a substantially cylindrical rod that is threaded into a bracket (24) which is rigidly mounted on the inside surface (26) of the closure wall (14). A nut (28) is threaded onto the latch bolt (18) and tightened to the outside surface (30) of the closure wall (14) to provide rigid mounting. The latch bolt (18) has a distal end (32) with a pair of axially spaced frusto-conical members (34) and (36) integrally formed with the latch bolt (18). The frusto-conical members (34), (36) have radially extending shoulders (38) and (40) on their undersides which are substantially perpendicular to the center axis of the latch bolt (18). The outer sides of the shoulders (38), (40) are tapered to the circumference of the latch bolt (18) so as to provide the frusto-conical shape. One of the frusto-conical members (34) is at the outermost distal end (32) of the latch bolt (18), while the other frusto-conical member (36) is axially spaced therefrom along the latch bolt's (18) center-line axis.

When the closure (14) is moved to the closed position, the distal end (32) of the latch bolt (18) engages the latch assembly (16) of the closure latch mechanism (10). As seen in FIG. 1, the latch assembly (16) is encased and supported by a latch support (42). The latch support (42) is "U" shaped and is rigidly mounted to the inside surface (44) of the structure wall (12). A receiver support (46) is mounted to the latch support (42) and comprises a hollow cylinder (48) extending toward the structure wall (12) and a base (50) integrally formed with the cylinder (48) and secured to the latch support (42). A cylindrical receiving member (52) slidably fits inside the cylinder (48) of the receiver support (46), and a compression spring (54) placed inside the receiver support (46) and under the receiving member (52) provides a bias to the receiving member (52) towards the latch bolt (18). A slot (56) is provided in the receiving member (52), and a pin (58) is inserted through aligned openings (not shown) in the receiver support (46) and through the slot (56) to restrict the movement of the receiving member (52) to the length of the slot (56). The receiving member (52) widens at its free end and is recessed at this end to form a cup shaped configuration (60) that has a chamfered interior corner (62) so as to mate with the frusto-conical member (34) of the latch bolt (18). When the closure (14) moves into the closed position, the distal end (32) of the latch bolt (18) enters the receiving member (52), and the force of the incoming latch bolt (18) is absorbed by the receiving member (52) moving inwardly and compressing the compression spring (54). Once the incoming force of the latch bolt (18) is absorbed, the compression spring (54) biases the receiving member (52) outwardly toward the latch bolt (18) thereby forcing the latch bolt (18) against the pair of latching members (20), (22).

As seen in FIG. 1, the pair of latching members (20), (22) have an inverted "L" shape configuration and have the long legs (64) and (66) of the "L" shape pivotally mounted to the base (50) of the receiver support (46) by way of a pair of pins (68) and (70). The short legs (72) and (74) of the "L" shape point inward toward each other and have their outer inside corners (76) and (78) chamfered so as to allow for easy entry of the latch bolt (18). A pair of tension springs (80) and (82) encircling the pins (68), (70), having one end connected to the latching members (20), (22) and their other ends connected to the base (50) of the receiver support (46), bias the latching members (20), (22) toward each other and the latched position. When the closure (14) approaches the closed position, the frusto-conical members (34) and (36) of the latch bolt (18) serially come in contact with the latching members (20), (22) and force the latching members (20), (22) to cam outwardly toward the unlatched position, as shown in FIG. 3. Once the shoulders (38), (40) of either frusto-conical member (34), (36) of the latch bolt (18) passes by the latching members (20), (22), the latching members (20), (22) are free to be biased by the tension springs (80), (82) back to the latching position and to engage the distal end (32) of the latch bolt (18). Once in the latched position, as shown in FIGS. 1 and 2, the latch bolt (18) is positively restrained from moving axially outward toward the open position.

To release the latch bolt (18) from the latched position, a cam plate (84) is provided to cam the latching members (20), (22) outwardly in opposition to the biasing force of the springs (80), (82) toward the unlatched position, as seen in FIG. 3. The cam plate (84) is rotatably mounted to a cam plate support (86) which is "U" shaped in configuration, although shallower in depth than the latch support (42), as seen in FIG. 1. To this end, the cam plate (84) and cam plate support (86) have aligned central openings (88) and (90), and the cam plate support (86) has an axially extending rim guide (92) secured thereto. The rim guide (92) at its upper end, as viewed in FIG. 1, is slidably inserted through the opening (88) of the cam plate (84), and at its lower end is slidably received by the receiving member (52). The cam plate support (86) lies in between the latch support (42) and the vehicle structure wall (12) and has its ends rigidly mounted between the ends of the latch support (42) and the vehicle structure wall (12). The cam plate support (86) also contains openings (93) and (94) allowing the latching members (20), (22) to extend through and above the cam plate support (86), respectively.

Figure 2:
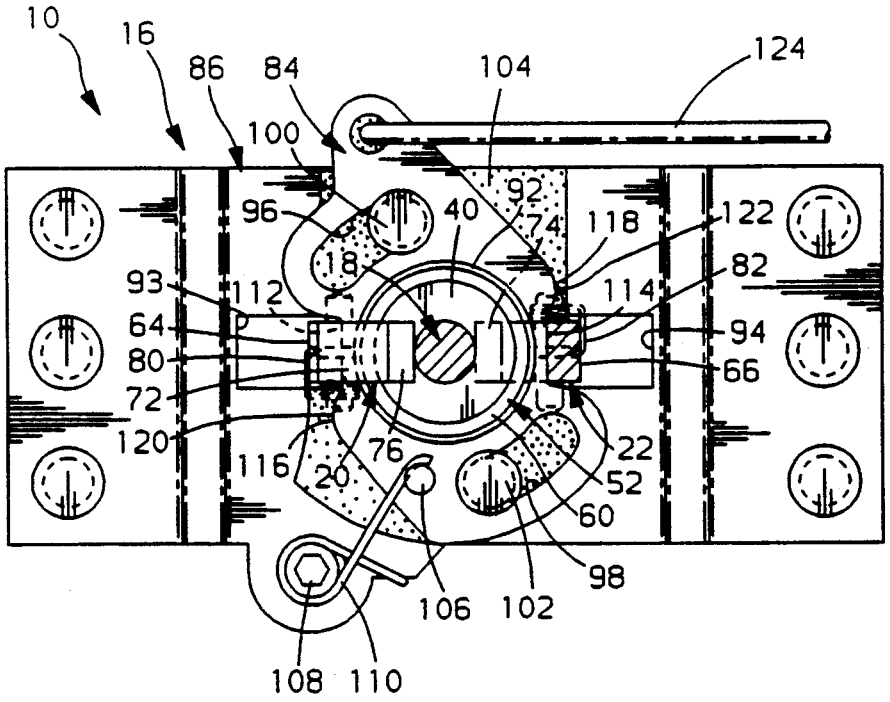
FIG. 2 is an elevational view with part shown in cross-section taken at line 2—2 of FIG. 1 and showing the present invention in the latched position.
Figure 3:
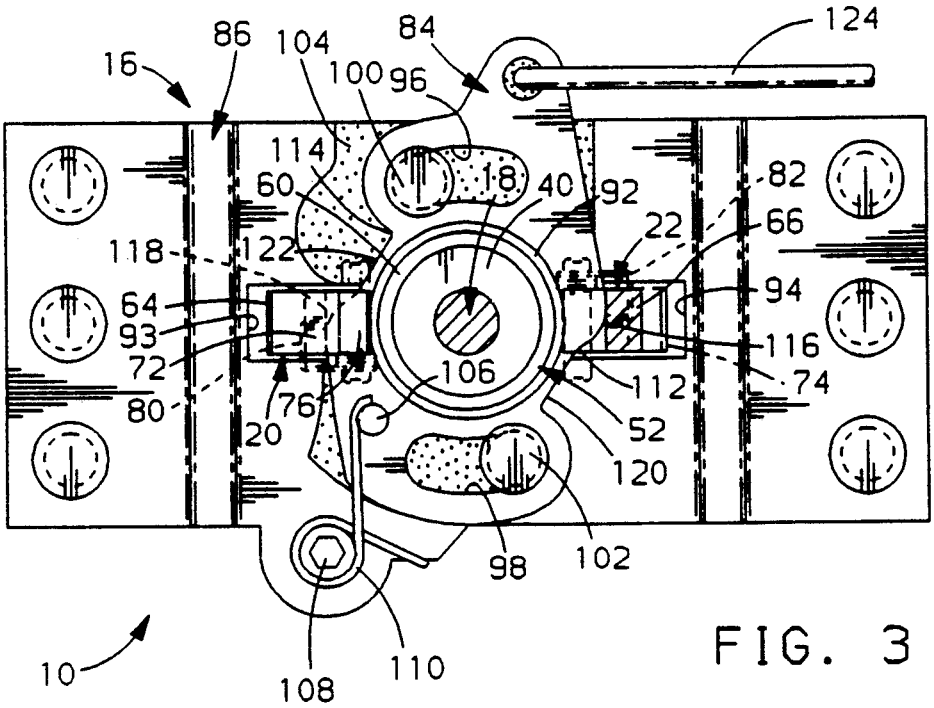
FIG. 3 is an elevational view like that shown in FIG. 2, but showing the present invention in the unlatched position.

As seen in FIGS. 2 and 3, the cam plate (84) contains a pair of similar arcuate slots (96) and (98), wherein two bolts (100) and (102) connect the cam plate (84) to the cam plate support (86) and allow the cam plate (84) to rotate about the center axis of the receiving member (52). As seen in FIG. 1, a plastic cam plate washer (104) is provided between the cam plate (84) and the cam plate support (86) to allow for rotation of the cam plate (84) relative to the cam plate support (86) with a minimum amount of friction. A pin (106) is welded onto the cam plate (84), and a bolt (108) is threaded into the cam plate support (86). A tension spring (110), encircling the bolt (108) and having its opposite ends respectively connected to the pin (106) and the cam plate support (86), is provided to bias the cam plate (84) toward the latched position, as seen in FIG. 2. As best shown in FIG. 2, the cam plate (84) has a pair of opposed recesses (112) and (114) and a pair of lobes (116) and (118) which define a pair of cam surfaces (120) and (122) along the side edge of the cam plate (84) and which are located adjacent the latching members (20), (22), respectively. In the latched position shown in FIG. 2, the latching members (20), (22) are received within the recesses (112), (114) of the cam plate (84). A release member (124) is connected to the cam plate (84), and upon pulling the release member (124), the cam plate (84) rotates causing the cam surfaces (120), (122) of the lobes (116), (118) to engage and force the latching members (20), (22) to move outwardly toward the unlatched position, as seen in FIG. 3. Once the latching members (20), (22) have extended radially outward past the shoulders (38), (40) of the frusto-conical members (34), (36) of the latch bolt (18), the compression spring (54) will cause the receiving member (52) to move upward forcing the latch bolt (18) into the open position.

Figure 4A:
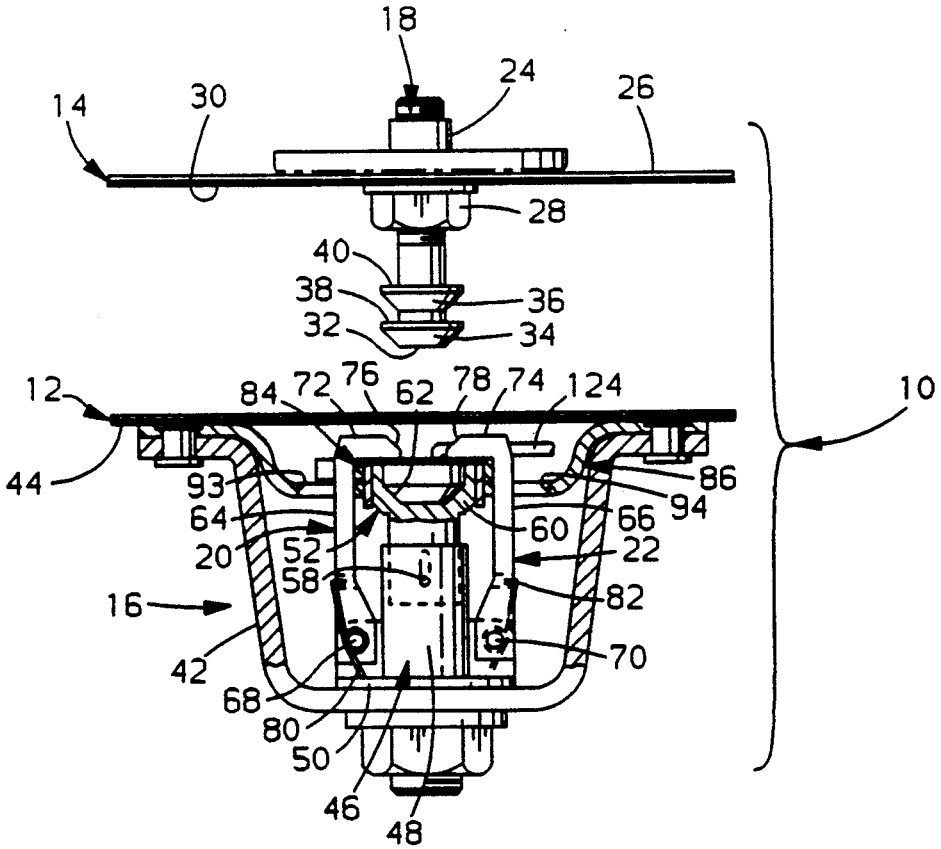
FIG. 4A is a side elevational view with portions cut-away showing the present invention in the open position.
Figure 4B:
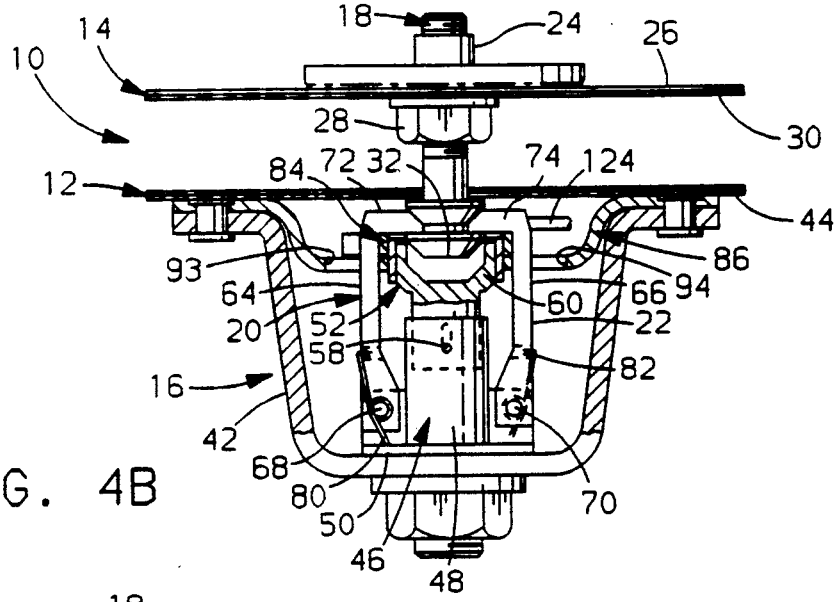
FIG. 4B is a side elevational view with portions cut-away showing the present invention in the safety latched position.

FIGS. 4A–D are side cutaway views of the four major positions the closure latch mechanism (10) experiences going from the open position to the closed and latched position and back to the open position. As shown in FIG. 4A, the vehicle closure (14) is in the open position allowing for access through the access opening, and the distal end (32) of the latch bolt (18) is clearly unlatched and spaced away from the vehicle support structure (12). As the closure (14) is moved toward the closed position, the first frusto-conical member (34) of the latch bolt (18) engages the latching members (20), (22) and forces the latching members (20), (22) to cam outwardly toward the unlatched position in opposition to the biasing forces of the tension springs (80), (82). When the shoulder (38) of the first frusto-conical member (34) travels past the latching members (20), (22), the tension springs (80), (82) move the latching members (20), (22) inward behind the shoulder (38) to the latched position, as shown in FIG. 4B. This is a safety latched position for the closure (14) as is commonly utilized by the automobile industry. In the safety latched position, the latch bolt (18) is prohibited from moving in lateral directions but is allowed to move within a limited axial range. The safety latched position restrains the latch bolt (18) from moving axially beyond the latching members (20), (22) to the open position.

Figure 4C:
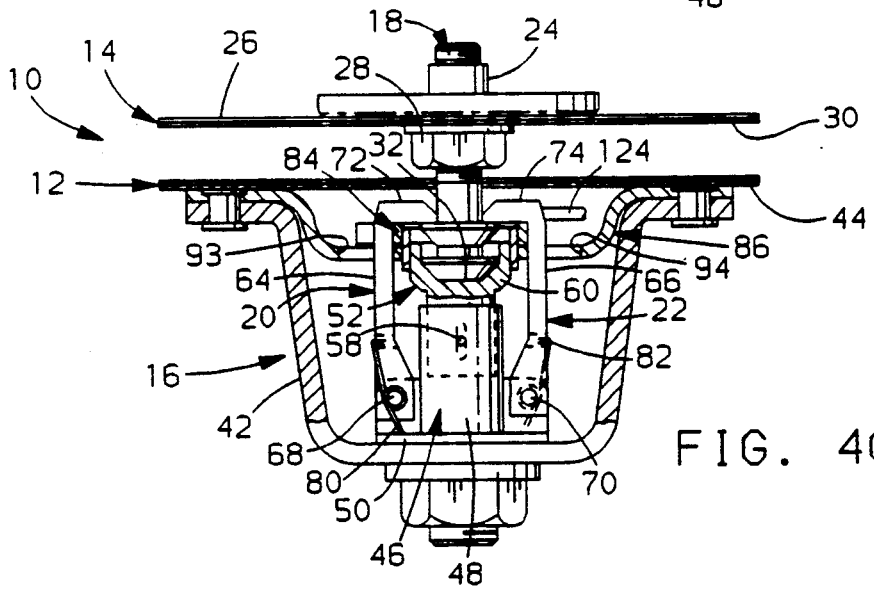
FIG. 4C is a side elevational view with portions cut-away showing the present invention in the primary latched position.

Upon further travel of the latch bolt (18) inwardly toward the receiving member (52), the second frusto-conical member (36) of the latch bolt (18) engages the latching members (20), (22) in the same manner as the first frusto-conical member (34) as previously described. At the same time, the distal end (32) of the latch bolt (18) engages and moves the receiver (52) inward thereby compressing the spring (54). The spring (54) causes the receiver (52) to be biased against the latch bolt (18) and the frusto-conical member's (36) shoulder (40) to be biased against the latching members (20), (22). As shown in FIG. 4C, the latching of the shoulder (40) of the second frusto-conical member (36) is a primary latched position for the closure (14). The primary latched position restrains lateral movement and outward axial movement of the latch bolt (18) as well as resisting inward axial movement thereof.

Figure 4D:
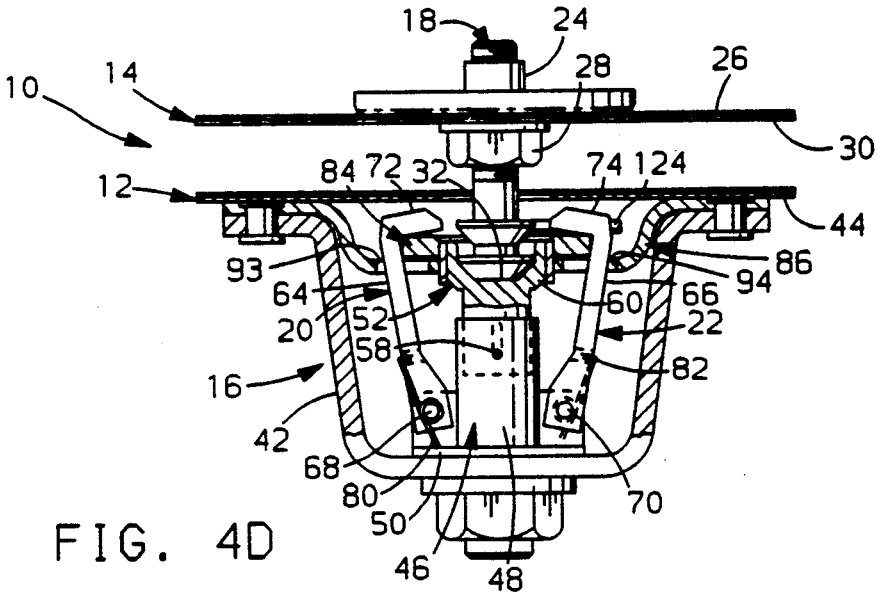
FIG. 4D is a side elevational view with portions cut-away showing the present invention in the unlatched position.

To unlatch the latch bolt (18), the release member (124), which is connected to the cam plate (84) as seen in FIGS. 2 and 3, is pulled by an operator, typically through the use of a door handle (not shown). By pulling the release member (124), the cam plate (84) rotates, and the cam surfaces (120), (122) cam the latching members (20), (22) outwardly until the latching members (20), (22) extend radially outward past the shoulders (38), (40) of the frusto-conical members (34), (36) of the latch bolt (18), as seen in FIG. 4D. When this occurs, the compression spring (54) will cause the receiving member (52) and the latch bolt (18) to move outwardly toward the open position. When the release member (124) is released, the tension springs (68), (70) will cause the latching members (20), (22) to be returned to their latched position, as seen in FIG. 4A.

The foregoing description is of a preferred embodiment of the invention, and it will be understood by those of ordinary skill in the art that various modifications and changes may be made without departing from the scope of the inventions defined in the claims.

The embodiments of the invention in which an exclusive property or privilege is claimed are defined as follows:

1. A latch mechanism in a vehicle wherein said vehicle has a body structure defining an access opening and has a closure supported by said body structure for movement between a closed position to close said access opening and an open position to open said access opening, and wherein aid latch mechanism provides a releasable latching of said closure to said body structure when in its closed position, said latch mechanism comprising, a latch bolt rigidly mounted to one of said body structure and closure and having a distal end, said distal end having sides and a bottom, a latch assembly mounted to the other of said body structure and closure and wherein said other body structure and closure provide an opening for receiving and engaging said distal end of said latch bolt to latch said closure to said body structure when said closure is moved to its closed position, said latch assembly including a support means, a cup shaped member slidably supported by said support means for movement between outer and inner positions, biasing means for biasing said cup shaped member toward its outer position, said cup shaped member being shaped complementary to said distal end of said latch bolt so as to surround said distal end around said said sides and said bottom of aid distal end, said cup shaped member slidably receiving said distal end of said latch bolt and being movable from its outer position toward its inner position on opposition to the biasing force of said biasing means when said closure is moved toward its closed position whereby lateral movement of said latch bolt along its longitudinal axis is prohibited, a latch means located wholly within said opening in said other body structure and closure and pivotally supported by said support means for movement between a latched position and an unlatched position, said latch means being biased towards its latched position, said latch means being engaged by said distal end of said latch bolt and cammed to its unlatched position when said closure is moved toward its closed position, said latch means returning toward its latched position to latch the distal end of said latch bolt within said cup shaped member when said closure is moved to its closed position whereby said latch bolt is also restrained against outward longitudinal movement toward the open position and resisted against inward longitudinal movement toward the closed position, and means for moving said latch means from its latched position to its unlatched position to enable said closure to be moved to its open position.

2. A latch mechanism as stated in claim 1, wherein said latch bolt includes at its distal end a pair of radially extending frusto-conical members whose undersides define shoulders which extend substantially perpendicular from the circumference of said latch bolt, and wherein the first of said members is engaged by said latching means to provide a safety latched position and the second of said shoulders is being engaged by said latching means to provide a primary latched position.

3. A latch mechanism in a vehicle wherein said vehicle has a body structure defining an access opening and has a closure supported by said body structure for movement between a closed position to close said access opening and an open position to open said access opening, wherein said latch mechanism provides a releasable latching of said closure to said body structure when in its closed position, said latch mechanism comprising, a substantially cylindrical latch bolt rigidly mounted to one of said body structure and closure and having a distal end comprising of a pair of axially spaced radially extending members having undersides extending substantially perpendicular from the circumference of said latch bolt and outer forward sides which ar tapered to the diameter of said latch bolt, a latch assembly mounted to the other of said body structure and closure and wherein said other body structure and closure provide an opening for receiving and engaging one of said pair of radially extending members on the distal end of said latch bolt to latch said closure to its closed position wherein engagement of the first of said pair of members provides a safety latch position and engagement of the second of said pair of members provides a primary latched position, said latched assembly including a support means, a cup shaped member slidably supported by said support means for movement between outer and inner positions, biasing means for biasing said cup shaped member toward its outer position, said cup shaped member being shaped complementary to said distal end of said latch bolt and surrounding said outer forward side of the outermost radially extending member of said distal end, said cup shaped member slidably receiving said distal end of said latch bolt and being movable from its outer position toward its inner position in opposition to the biasing force of said biasing means when said closure is moved toward its closed position whereby lateral movement of said latch bolt along its longitudinal axis is prohibited, a pair of latching members located wholly within said opening in said other body structure and closure and pivotally supported by said support means for movement between a latched position and an unlatched position and biased toward its latched position, said pair of latching members being engaged by said distal end of said latch bolt and cammed to its unlatched position when said closure is moved toward its closed position, said pair of latching members returning toward its latched position to latch the distal end of said latch bolt within said cup shaped member when said closure is moved to its closed position whereby said latch bolt is also restrained against outward longitudinal movement toward the open position and resisted against inward longitudinal movement toward the closed position when in said primary latched position, a rotatable cam in contact with said pair of latching members and operable to cam said pair of latching members to their unlatched positions when rotated in a first direction, second spring means for rotating said cam in the opposite direction to allow said latching members to be moved to their latched position when said cam is released, and a manually operable release member connected to said cam for rotating said cam in said first direction.

4. A latch mechanism as stated in claim 3, wherein said latch bolt is secured to a sliding door of a van and said latch assembly is secured to the vehicle body structure.

* * * * *